US011763970B2

(12) United States Patent
Jeon et al.

(10) Patent No.: US 11,763,970 B2
(45) Date of Patent: Sep. 19, 2023

(54) COIL ELECTRONIC COMPONENT

(71) Applicant: SAMSUNG ELECTRO-MECHANICS CO., LTD., Suwon-si (KR)

(72) Inventors: Hyung Jin Jeon, Suwon-si (KR); Soon Kwang Kwon, Suwon-si (KR); Seon Woo Oh, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 912 days.

(21) Appl. No.: 16/749,376

(22) Filed: Jan. 22, 2020

(65) Prior Publication Data

US 2021/0027926 A1 Jan. 28, 2021

(30) Foreign Application Priority Data

Jul. 24, 2019 (KR) ..... 10-2019-0089738

(51) Int. Cl.

| | |
|---|---|
| ***H01F 5/04*** | (2006.01) |
| ***H01F 17/04*** | (2006.01) |
| ***H01F 27/255*** | (2006.01) |
| ***H01F 41/04*** | (2006.01) |

(52) U.S. Cl.

CPC ..... *H01F 5/04* (2013.01); *H01F 17/04* (2013.01); *H01F 27/255* (2013.01); *H01F 41/04* (2013.01); *H01F 2017/048* (2013.01)

(58) Field of Classification Search

CPC ..... H01F 5/04; H01F 17/04; H01F 27/255; H01F 41/04; H01F 2017/048

See application file for complete search history.

(56) References Cited

U.S. PATENT DOCUMENTS

2009/0051474 A1* 2/2009 Lee ..... H01F 17/04 336/83
2013/0263440 A1* 10/2013 Lee ..... H01F 41/127 29/605
2014/0176284 A1* 6/2014 Lee ..... H01F 17/0013 336/200

(Continued)

FOREIGN PATENT DOCUMENTS

JP 2007-067214 A 3/2007
KR 10-2015-0127999 A 11/2015

(Continued)

OTHER PUBLICATIONS

Korean Office Action dated May 26, 2020 issued in Korean Patent Application No. 10-2019-0089738 (with English translation).

*Primary Examiner* — Marlon T Fletcher
*Assistant Examiner* — Malcolm Barnes
(74) *Attorney, Agent, or Firm* — Morgan, Lewis & Bockius LLP

(57) ABSTRACT

A coil electronic component includes a support substrate including a metal plate having a plurality of through-holes formed therein, a coil pattern disposed on at least a surface of the support substrate and having a core region in the center of the coil pattern, an encapsulant disposed on at least a portion of the support substrate, the coil pattern, and at least a portion of the metal plate, and an external electrode disposed outside of the encapsulant and connected to the coil pattern.

19 Claims, 5 Drawing Sheets

(56) References Cited

U.S. PATENT DOCUMENTS

| | | | | |
|---|---|---|---|---|
| 2015/0102890 | A1* | 4/2015 | Nakamura | H01F 27/2804 336/200 |
| 2015/0325510 | A1* | 11/2015 | Choi | H01L 21/486 257/774 |
| 2015/0380152 | A1* | 12/2015 | Itoh | H01F 41/041 336/200 |
| 2017/0178790 | A1* | 6/2017 | Kim | H01F 27/2804 |
| 2017/0345556 | A1* | 11/2017 | Kim | H01F 17/0013 |
| 2018/0096783 | A1* | 4/2018 | Fukuda | H01F 27/366 |
| 2018/0174736 | A1* | 6/2018 | Li | H01F 41/042 |
| 2018/0197672 | A1* | 7/2018 | Kim | H01F 41/041 |
| 2019/0198223 | A1 | 6/2019 | Kim | |

FOREIGN PATENT DOCUMENTS

| | | | |
|---|---|---|---|
| KR | 10-1681200 | B1 | 12/2016 |
| KR | 10-2019-0078052 | A | 7/2019 |

* cited by examiner

COIL ELECTRONIC COMPONENT

CROSS-REFERENCE TO RELATED APPLICATION(S)

The present application claims the benefit of priority to Korean Patent Application No. 10-2019-0089738 filed on Jul. 24, 2019 in the Korean Intellectual Property Office, the disclosure of which is incorporated herein by reference in its entirety.

TECHNICAL FIELD

The present disclosure relates to a coil electronic component.

BACKGROUND

With the miniaturization and thinning of electronic devices such as digital TVs, mobile phones, and laptop PCs, coil components used in these electronic devices are required to be made smaller and thinner. To satisfy these purposes, the research and development of coil electronic components having various forms of wirings or thin films are being actively conducted.

A main issue according to the miniaturization and thinning of coil electronic components is to provide the same properties as conventional coil components, regardless of such miniaturization and thinning. In order to satisfy this requirement, it is necessary for a ratio of a magnetic material to be increased in a core filled with the magnetic material, but there is a limit to increasing the ratio due to the strength of an inductor body and the change in frequency characteristics caused by insulation properties.

In the case of the coil electronic component, attempts have been made to further reduce a thickness of a chip depending on changes in complexity of a recent set, multifunctionality, slimness, and the like. Accordingly, in the art, a method for ensuring high performance and reliability even with the trend for slimness of chips is required.

SUMMARY

An aspect of the present disclosure is to implement a coil electronic component capable of improving permeability and reducing loss to improve performance, and improving structural stability due to excellent flexibility and rigidity of a support substrate.

According to an aspect of the present disclosure, a novel structure of a coil electronic component is proposed, and, in detail, a coil electronic component may include a support substrate including a metal plate having a plurality of through-holes formed therein, a coil pattern disposed on at least a surface of the support substrate and having a core region in a center of the coil pattern, an encapsulant disposed on at least a portion of the support substrate, the coil pattern, and at least a portion of the metal plate, and an external electrode disposed outside of the encapsulant and connected to the coil pattern.

The metal plate may have a mesh structure.

The plurality of through-holes may be arranged in the form of a grid.

The support substrate may further include an insulating layer disposed on at least one surface of the metal plate.

The insulating layer may include a plurality of magnetic particles.

The plurality of magnetic particles may include a material that is identical with a material of the metal plate.

The material may include an Fe-based alloy.

The coil pattern may include a plating layer, and the plurality of magnetic particles may be seeds of the plating layer.

A portion of the plurality of magnetic particles may be in contact with the coil pattern.

A portion of the plurality of magnetic particles may be exposed to an outside through a surface of the insulating layer.

The insulating layer may further include an insulating resin, and the plurality of magnetic metal particles are dispersed in the insulating resin.

A region of the insulating layer may be disposed in at least a portion of the plurality of through-holes.

An outer side surface of the metal plate may be spaced apart from the external electrode.

The metal plate may be composed of a plurality of metal plates stacked in a thickness direction of the metal plate.

The coil pattern may include a lead-out pattern disposed in an outermost portion of the coil pattern and exposed to an outside of the encapsulant to be connected to the external electrode in a length direction of the coil electronic component.

The insulating layer may further include an insulating resin, and the plurality of magnetic metal particles are dispersed in the insulating resin.

According to an aspect of the present disclosure, a coil electronic component may include a support substrate including a metal plate having a plurality of through-holes formed therein; a coil pattern disposed on at least a surface of the support substrate and having a core region in a center of the coil pattern; and an encapsulant disposed on at least a portion of the support substrate, the coil pattern, and at least a portion of the metal plate, wherein a magnetic material is arranged in at least a portion of the plurality of through-holes.

The plurality of through-holes may be regularly arranged in columns and rows in the metal plate.

The support substrate may further include an insulating layer disposed on at least one surface of the metal plate.

The plurality of through-holes may be disposed to overlap the coil pattern in a thickness direction of the metal plate.

Other features and aspects will be apparent from the following detailed description, the drawings, and the claims.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
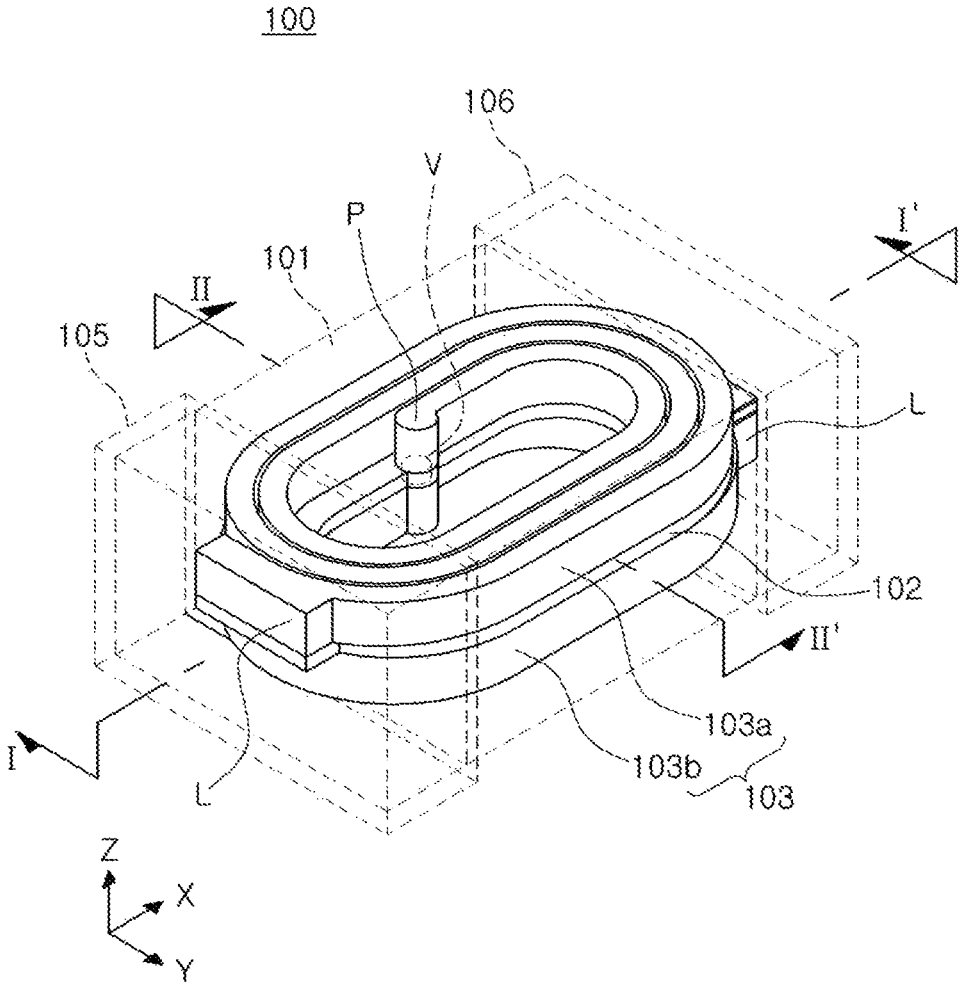
FIG. 1 is a schematic transmission perspective view illustrating a coil electronic component according to an exemplary embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Figure 2:
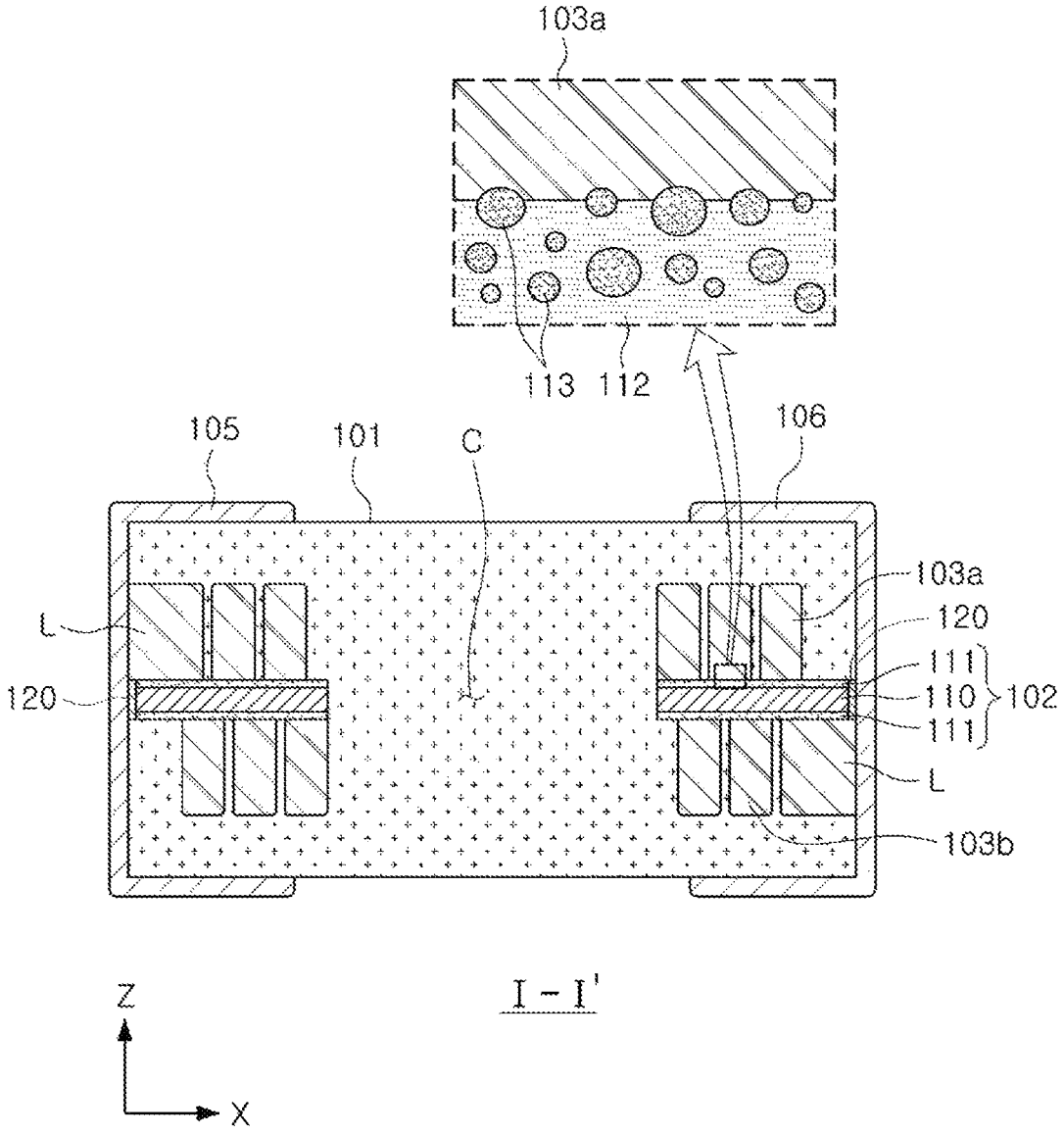
FIG. 2 is a cross-sectional view taken along line I-I' of FIG. 1.
Figure 3:
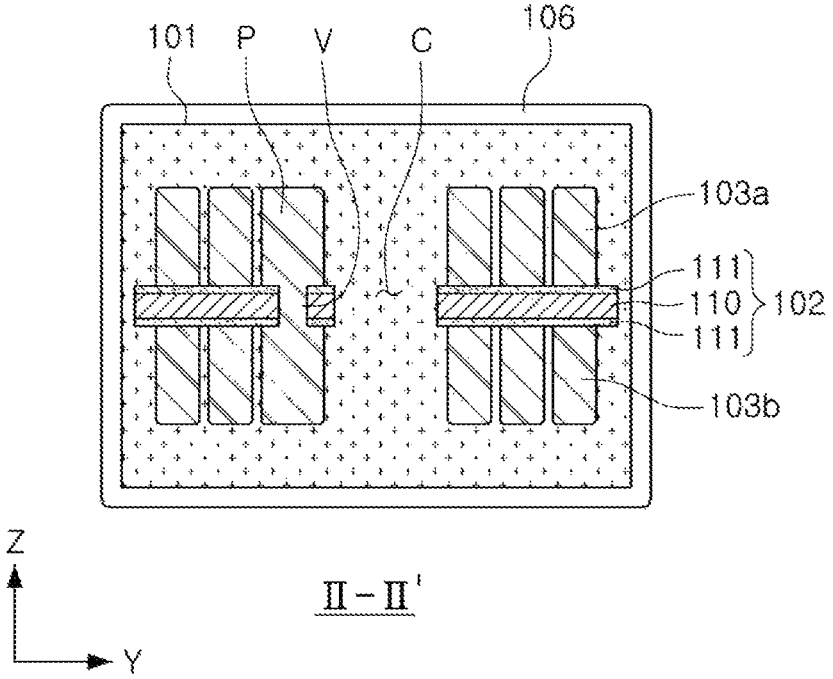
FIG. 3 is a cross section taken along line II-II' of FIG. 1.
Figure 4:
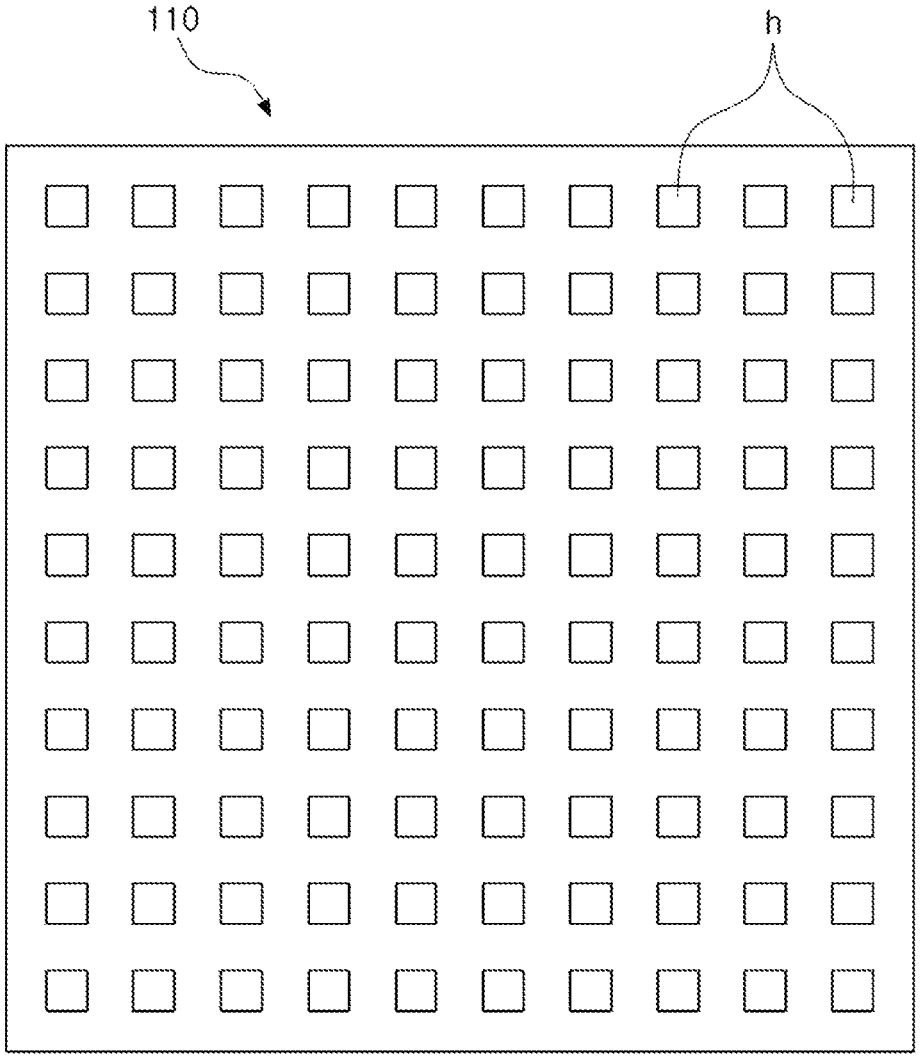
FIGS. 4, 5, and 6 illustrate an example of a support substrate to be employed in a coil electronic component.
Figure 5:
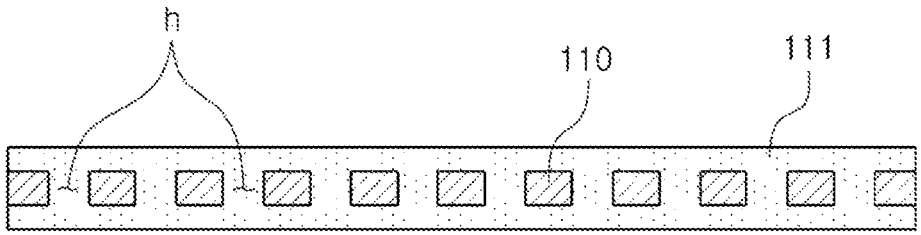
Figure 6:
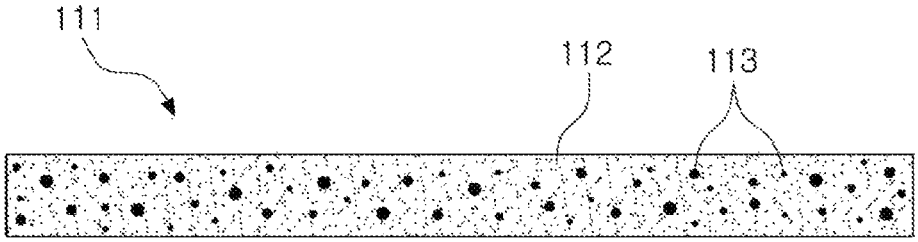

FIG. 1 is a schematic transmission perspective view illustrating a coil electronic component according to an exemplary embodiment of the present disclosure. FIGS. 2 and 3 are a cross-sectional view taken along line I-I' and a cross-sectional view taken along line II-II' of FIG. 1, respectively. FIGS. 4 to 6 illustrate an example of a supporting plate to be employed in a coil electronic component. Here, FIG. 4 is a plan view of a metal plate viewed from the top or the bottom, while FIGS. 5 and 6 are cross-sectional views of a supporting plate and an insulating layer, respectively.

Referring to FIGS. 1 to 6, a coil electronic component 100 according to an exemplary embodiment of the present disclosure includes a support substrate 102, a coil pattern 103, an encapsulant 101, and external electrodes 105 and 116, and the support substrate 102 includes a metal plate 110 having a plurality of through-holes h formed therein. These plurality of through-holes h may be disposed to overlap the coil pattern 103 in a thickness direction of the metal plate 110.

The encapsulant 101 may form an appearance of a coil electronic component 100 while encapsulating at least a portion of the support substrate 102, the coil pattern 103, and the metal plate 110. In this case, the encapsulant 101 may be formed to expose a region of a lead-out pattern L, connected to the coil pattern 103, externally. The encapsulant 101 may include a plurality of magnetic particles, and an insulating resin may be interposed between the magnetic particles. Moreover, an insulating film may be coated on a surface of the magnetic particles. As a plurality of magnetic particles are included in the encapsulant 101, permeability of the encapsulant 101 may be improved. Accordingly, performance of the coil electronic component 100 may be improved.

The magnetic particles, which may be included in the encapsulant 101, may be ferrite, metal, or the like. In the case of the metal, the magnetic particles may include an iron (Fe)-based alloy, or the like, by way of example. In detail, the magnetic particles may include a nanocrystalline-based alloy composed of Fe—Si—B—Cr, a Fe—Ni-based alloy, or the like. As described above, when the magnetic particles include the Fe-based alloy, magnetic properties such as magnetic permeability are excellent, but it may be vulnerable to Electrostatic Discharge (ESD). Thus, an additional insulating structure may be interposed between the coil pattern 103 and the magnetic particles.

The coil pattern 103 may have a spiral structure forming one or more turns, and may formed in at least one surface of the support substrate 102. According to an exemplary embodiment of the present disclosure, an example is described, in which the coil pattern 103 includes first and second coil patterns 103*a* and 103*b*, disposed on two surfaces, opposing each other, of the support substrate 102. In this case, the first and second coil patterns 103*a* and 103*b* may include a pad region P, and may be connected to each other by a via V passing through the support substrate 102. The coil pattern 103 may be formed using a plating process used in the art, such as pattern plating, anisotropic plating, isotropic plating, or the like, and may be formed to have a multilayer structure using a plurality of processes among those processes described above. Accordingly, the coil component 103 may include a plating layer. As will be described later, a plating layer of the coil pattern 103 may be formed on the insulating layer 111 of the support substrate 102, and the plurality of magnetic particles 113, included in the insulating layer 111, may be provided as seeds of the coil pattern 103. As illustrated in the drawings, the coil pattern 103 has a core region C in the center thereof. The core region C of the coil pattern 103 may be filled with the encapsulant 101.

The lead-out pattern L is disposed in an outermost portion of the coil pattern 103 to provide a connection path with the external electrodes 105 and 106, and may have a structure formed integrally with the coil pattern 103. In this case, as illustrated in the drawings, for connection with the external electrodes 105 and 106, the lead-out pattern L may have a form having a width greater than that of the coil pattern 103. Here, the width corresponds to a width in an X direction with reference to FIG. 1.

The support substrate 102 supports the coil pattern 103, or the like, and may include a metal plate 110. The metal plate 110 includes a magnetic metal. The magnetic metal may be an Fe-based alloy, of the like, by way of example. In detail, the metal plate 110 may include a nanocrystalline-based alloy of Fe—Si—B—Cr, a Fe—Ni-based alloy, or the like. Moreover, the metal plate 110 may include a plurality of metal plates, the materials of which may include the same material as each other. The material may be, e.g., an Fe-based alloy. In the related art, a substrate for supporting a coil pattern may be provided as an insulating substrate composed of PPG, and the like.

Accordingly, there is a limit to increasing an amount of a magnetic material in the encapsulant 101. According to an exemplary embodiment of the present disclosure, the support substrate 102 is provided as a metal plate, so permeability of the encapsulant 101 may be sufficiently secured and performance of the coil electronic component 100 may be improved.

The metal plate 110 includes a plurality of through-holes h, and the plurality of through-holes h are arranged in the form of a grid as illustrated in FIG. 4. Moreover, due to the arrangement structure of the through-hole h described above, the metal plate 110 may have a mesh structure. In this case, the plurality of through-holes h may be regularly arranged in columns and rows in the metal plate 110.

When the metal plate 110 is used, it is advantageous in terms of permeability, but eddy loss caused by a magnetic field may occur during an operation of the coil electronic component 110. The plurality of through-holes h, formed in the metal plate 110, may be lost, so performance of the coil electronic component 100 may be improved. In addition, the through-hole h is formed in the metal plate 110, so it is advantageous to control magnetic anisotropy of the metal plate 110 in comparison with the case in which a through-hole is not provided. In other words, when the through-hole h is formed in the metal plate 110, high permeability may be implemented in a thickness direction of the metal plate 110, similar to a flow direction of a magnetic field inside the encapsulant 101.

Meanwhile, as illustrated in the drawings, an outer side surface of the metal plate 110 may be spaced apart from the external electrodes 105 and 106. Here, due to a structure described above, formation of an unintentional current path may be reduced. In this case, in order to improve insulation properties between the metal plate 110 and the external electrodes 105 and 106, an insulating portion 120 may be interposed therebetween.

In addition to improvement of magnetic properties described above, the plurality of through-holes h, formed in the metal plate 110, may contribute to structural stability. When the metal plate 110 is used, rigidity of the support substrate 102 is improved. Furthermore, flexibility of the support substrate 102 may be improved due to the plurality of through-holes h. The metal plate 110 with structural stability improved as described above is used to more easily manufacture the coil pattern 103.

As illustrated in the drawings, the support substrate 102 may include the insulating layer 111 disposed in at least one surface of the metal plate 110. According to an exemplary embodiment of the present disclosure, it is described that insulating layers 111 are formed on both surfaces of the metal plate 110, by way of example. The insulating layer 111 may prevent the metal plate 110 from being in contact with the coil pattern 103, and may also function to protect the metal plate 110 from moisture, and the like.

As illustrated in FIG. 5, a region of the insulating layer 111 may fill at least a portion of the through-hole h of the metal plate 110, and may have a form filling the entirety of the through-hole h in FIG. 5. As the insulating layer 111 fills the through-hole h of the metal plate 110, binding force therebetween is improved, so structural stability of the support substrate 102 may be further improved.

As illustrated in FIG. 6, the insulating layer 111 may include a plurality of magnetic particles 113. In this case, the insulating layer 111 may have a form in which the plurality of magnetic metal particles 113 are dispersed in an insulating resin 112 such as an epoxy, and the like. When the magnetic particles 113 are provided in the insulating layer 111, permeability of the encapsulant 101 may be improved. Here, the plurality of magnetic particles 113 may include the same material as the metal plate 110, and the material may include an Fe-based alloy. Furthermore, the magnetic particles 113, included in the insulating layer 111, may include a material the same as magnetic particles included in the encapsulant 101.

The plurality of magnetic particles 113, included in the insulating layer 111, may function as seeds for formation of the coil pattern 103. In detail, the insulating layer 111 may be seeds of a plating layer included in the coil pattern 103. Accordingly, a portion of the plurality of magnetic particles 113 may be in contact with the coil pattern 103. To this end, as illustrated in FIG. 6, a portion of the magnetic particles 113 may be exposed to a surface of the insulating resin 112.

The external electrodes 105 and 106 are disposed outside of the encapsulant 101 to be connected to the lead-out pattern L. The external electrodes 105 and 106 may be formed using a paste including a metal with excellent electrical conductivity. For example, the paste may be a conductive paste including one among nickel (Ni), copper (Cu), tin (Sn), and silver (Ag), or alloys thereof. Moreover, a plating layer may be further formed on the external electrodes 105 and 106. In this case, the plating layer may include at least one selected from the group consisting of nickel (Ni), copper (Cu), and tin (Sn), and for example, a nickel (Ni) layer and a tin (Sn) layer may be sequentially formed therein.

Figure 7:
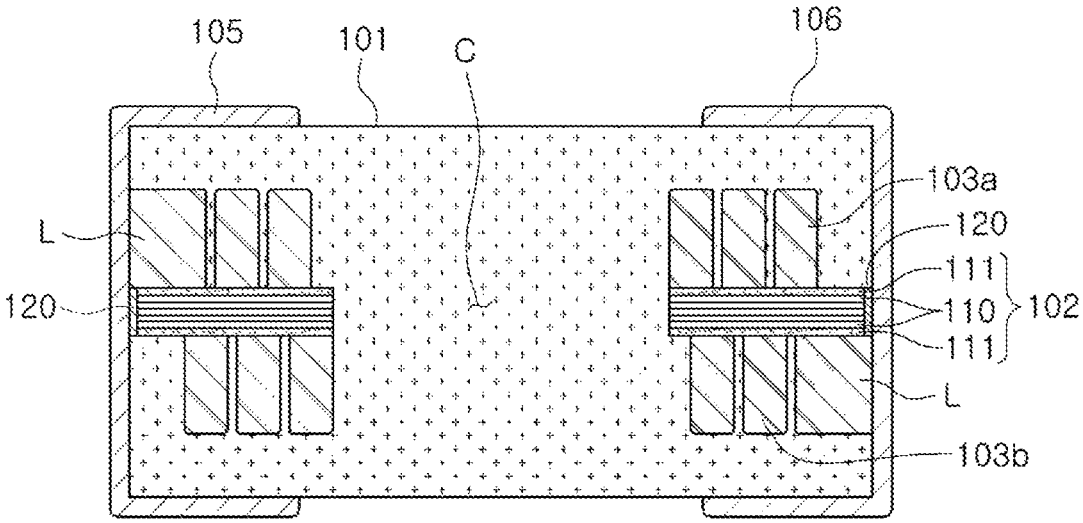
FIG. 7 illustrates a coil electronic component according to a modified exemplary embodiment of the present disclosure.

FIG. 7 illustrates a coil electronic component according to a modified exemplary embodiment of the present disclosure. In an embodiment of FIG. 7, the metal plate 110 is provided as a plurality of metal plates stacked in a thickness direction of the metal plate 110. Other than this, it may be implemented in the same manner as the preceding embodiment. In this case, each of the plurality of metal plates 110 may have a plurality of through-holes. In the support substrate 102, insulating layers 111 may be disposed in an upper portion and a lower portion of a stacking structure of the plurality of metal plates 110. In a modified embodiment in which the plurality of metal plates 110 are used, a form may be provided, suitable for adjusting permeability, a thickness of the support substrate 102, and the like.

As set forth above, according to an embodiment in the present disclosure, in the case of a coil electronic component, permeability is improved and loss is reduced, so performance may be improved. Moreover, due to excellent flexibility and rigidity of a support substrate, structural stability may be improved.

While exemplary embodiments have been shown and described above, it will be apparent to those skilled in the art that modifications and variations could be made without departing from the scope of the present invention as defined by the appended claims.

What is claimed is:

1. A coil electronic component, comprising:

a support substrate including a metal plate having a plurality of through-holes formed therein;

a coil pattern disposed on at least a surface of the support substrate and having a core region in a center of the coil pattern;

an encapsulant disposed on at least a portion of the support substrate, the coil pattern, and at least a portion of the metal plate; and an external electrode disposed outside of the encapsulant and connected to the coil pattern, wherein the metal plate has a mesh structure.

2. The coil electronic component of claim 1, wherein the support substrate further includes an insulating layer disposed on at least one surface of the metal plate.

3. The coil electronic component of claim 2, wherein the insulating layer includes a plurality of magnetic particles.

4. The coil electronic component of claim 3, wherein the plurality of magnetic particles include a material that is identical with a material of the metal plate.

5. The coil electronic component of claim 4, wherein the material includes an Fe-based alloy.

6. The coil electronic component of claim 3, wherein the coil pattern includes a plating layer, and the plurality of magnetic particles are seeds of the plating layer.

7. The coil electronic component of claim 3, wherein a portion of the plurality of magnetic particles is in contact with the coil pattern.

8. The coil electronic component of claim 3, wherein a portion of the plurality of magnetic particles are exposed to an outside through a surface of the insulating layer.

9. The coil electronic component of claim 3, wherein the insulating layer further include an insulating resin, and the plurality of magnetic metal particles are dispersed in the insulating resin.

10. The coil electronic component of claim 2, wherein a region of the insulating layer is disposed in at least a portion of the plurality of through-holes.

11. The coil electronic component of claim 1, wherein an outer side surface of the metal plate is spaced apart from the external electrode.

12. The coil electronic component of claim 1, wherein the metal plate is composed of a plurality of metal plates stacked in a thickness direction of the metal plate.

13. The coil electronic component of claim 1, wherein the coil pattern includes a lead-out pattern disposed in an outermost portion of the coil pattern and exposed to an outside of the encapsulant to be connected to the external electrode in a length direction of the coil electronic component.

14. The coil electronic component of claim 13, wherein a width of the lead-out pattern in the length direction is greater than a width of a remaining portion of the coil pattern in the length direction.

15. A coil electronic component, comprising:

a support substrate including a metal plate having a plurality of through-holes formed therein;

a coil pattern disposed on at least a surface of the support substrate and having a core region in a center of the coil pattern;

an encapsulant disposed on at least a portion of the support substrate, the coil pattern, and at least a portion of the metal plate; and an external electrode disposed outside of the encapsulant and connected to the coil pattern, wherein the plurality of through-holes are arranged in a form of a grid.

16. A coil electronic component, comprising:

a support substrate including a metal plate having a plurality of through-holes formed therein;

a coil pattern disposed on at least a surface of the support substrate and having a core region in a center of the coil pattern; and an encapsulant disposed on at least a portion of the support substrate, the coil pattern, and at least a portion of the metal plate, wherein a magnetic material is arranged in at least two of the plurality of through-holes.

17. The coil electronic component of claim 16, wherein the plurality of through-holes are regularly arranged in columns and rows in the metal plate.

18. The coil electronic component of claim 16, wherein the support substrate further includes an insulating layer disposed on at least one surface of the metal plate.

19. The coil electronic component of claim 16, wherein the plurality of through-holes are disposed to overlap the coil pattern in a thickness direction of the metal plate.

* * * * *